US008246724B2

(12) United States Patent
Leonhardt

(10) Patent No.: US 8,246,724 B2
(45) Date of Patent: Aug. 21, 2012

(54) METHOD FOR AIR TREATMENT IN A DISPLAY CABINET AND CABINET FOR IMPLEMENTING THE METHOD

(75) Inventor: Norbert Leonhardt, Frankfurt am Main (DE)

(73) Assignee: Glasbau Hahn GmbH, Frankfurt am Main (DE)

( * ) Notice: Subject to any disclaimer, the term of this patent is extended or adjusted under 35 U.S.C. 154(b) by 248 days.

(21) Appl. No.: 12/592,093

(22) Filed: Nov. 19, 2009

(65) Prior Publication Data

US 2010/0079044 A1 Apr. 1, 2010

Related U.S. Application Data

(63) Continuation-in-part of application No. 10/559,031, filed as application No. PCT/EP2004/005778 on May 28, 2004, now abandoned.

(30) Foreign Application Priority Data

May 30, 2003 (DE) ..... 103 24 685

(51) Int. Cl.

| | |
|---|---|
| ***B01D 46/00*** | (2006.01) |
| ***B01D 47/02*** | (2006.01) |
| ***B01D 46/04*** | (2006.01) |
| ***B01D 47/00*** | (2006.01) |
| ***B01J 19/24*** | (2006.01) |
| ***B01F 3/04*** | (2006.01) |
| ***C10J 1/08*** | (2006.01) |

(52) U.S. Cl. ..... 95/273; 422/231; 96/351; 96/329; 96/278; 96/279; 95/226; 261/123; 261/119.1; 261/122.1

(58) Field of Classification Search ..... 422/231; 96/351, 329, 278–279; 95/226; 261/123, 261/119.1, 122.1

See application file for complete search history.

(56) References Cited

U.S. PATENT DOCUMENTS 2,066,013 A * 12/1936 Murphy et al. ..... 62/255

(Continued)

FOREIGN PATENT DOCUMENTS

DE 3805212 8/1989

(Continued)

OTHER PUBLICATIONS

English translation of International Preliminary Report on Patentability of PCT/EP2004/005778 (mail date Apr. 2006).

(Continued)

*Primary Examiner* — Jason M Greene
*Assistant Examiner* — Amber Orlando
(74) *Attorney, Agent, or Firm* — Bucknam and Archer

(57) ABSTRACT

In a method for air treatment in a display cabinet for the storage and/or display of objects, whose walls, floor and roof structure more or less enclose the inside space of the display cabinet and in which a forced inflow of air from an air delivery system connected to the inside space (1) of the cabinet maintains a slight excess pressure compared with the air outside it, the said airflow passes through suitable dust or gas filtration means before entering the cabinet and its air humidity is adjusted and/or controlled by means of a cooling device. After filtration, the airflow passes through a catalyser (8) present in a liquid (7), the air picks up moisture from the liquid and is rendered completely free from germs. In this manner and in a simple way, a completely germ-free atmosphere is produced inside the display cabinet. A display cabinet for implementing the method has a corresponding structure.

17 Claims, 1 Drawing Sheet

U.S. PATENT DOCUMENTS 5,711,705 A * 1/1998 Krainiak et al. ..... 454/57

FOREIGN PATENT DOCUMENTS

| | | | |
|---|---|---|---|
| DE | 196 10 345 | | 11/1997 |
| DE | 19903022 | | 10/1999 |
| DE | 198 26 930 | | 12/1999 |
| DE | 19826930 | | 12/1999 |
| EP | 1281429 | | 2/2003 |
| GB | 2349202 | | 10/2000 |
| JP | 05-285420 | A | 11/1993 |
| JP | 07-324789 | A | 12/1995 |
| JP | 08-131882 | A | 5/1996 |
| JP | 2000-283512 | A | 10/2000 |
| JP | 2001-153412 | A | 6/2001 |
| WO | 0184986 | | 11/2001 |

OTHER PUBLICATIONS

Koppe, "High Performance Cooling Towers Without Legionella" Mar. 12, 2008 Presentation at Rostock.

International Search Report, Sep. 20, 2004.

* cited by examiner

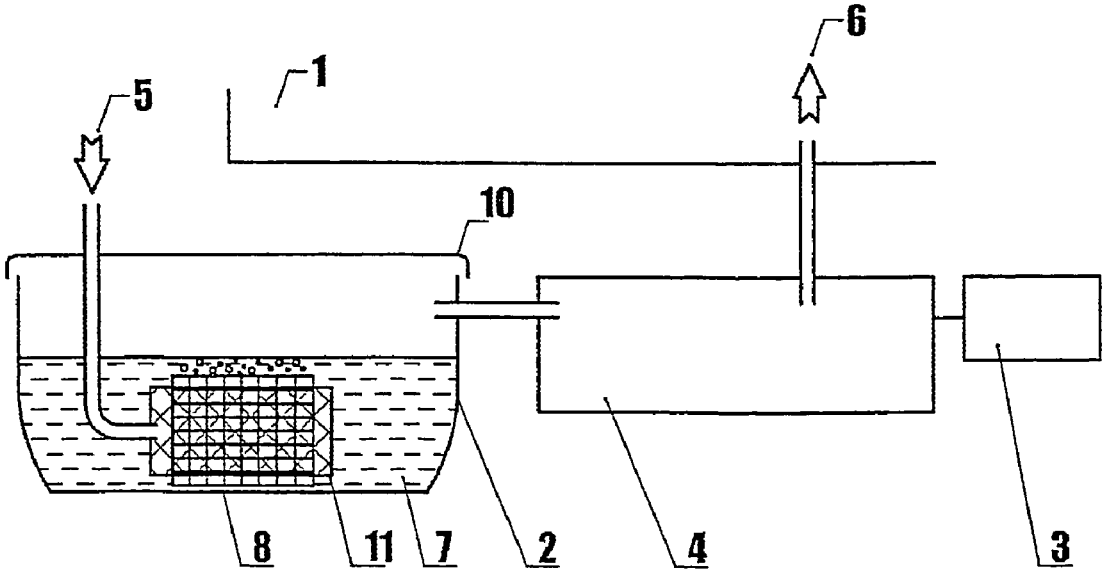
6
1
5
10
8
11
7
2
4
3

METHOD FOR AIR TREATMENT IN A DISPLAY CABINET AND CABINET FOR IMPLEMENTING THE METHOD

This application is a continuation-in-part application of abandoned U.S. patent application Ser. No. 10/559,031, filed Nov. 30, 2005, which prior application claimed priority under 35 U.S.C. Section 119 to German Application No. 103 24 685.1, filed May 30, 2003, and under 35 U.S.C. Section 365 to PCT/EP2004/005778, filed May 28, 2004.

The invention concerns a method for air treatment in a display cabinet for the storage and/or display of objects, whose walls, floor and roof structure more or less enclose the inside space of the display cabinet and in which a forced inflow of air from an air delivery system connected to the inside space of the cabinet maintains a slight excess pressure compared with the air outside it, this airflow passing through suitable dust or gas filtration means before entering the cabinet and having its air humidity adjusted and/or controlled, and a corresponding display cabinet for implementing the method.

Such a method and a corresponding display cabinet are already known. Thus, DE-PS 38 05 212 C2 describes a cabinet for the storage and/or display of objects, in which, for the protection of the objects displayed, the air surrounding them inside the cabinet is kept not only free from dust but also within a desired range of air humidity. It is also possible to fill the inside space with a neutral gas, if this is required for the protection of the objects displayed.

Besides freedom from dust, controlled humidity, etc., the case can also arise that certain objects inside the display cabinet require surroundings free from germs.

Thus, the purpose of the present invention is to indicate a method of the type mentioned above, in which the airflow passing into the display cabinet is rendered germ-free, and to supplement the equipment of a display cabinet of the type mentioned at the start, in such manner that a germ-free atmosphere is produced inside the cabinet.

With a method and equipment of the type mentioned earlier, these objectives are achieved by passing the airflow, after filtration, into a container holding a liquid and providing in the said liquid a catalyser by means of which the air is rendered completely free from germs.

Since even an airtight cabinet is never completely impervious to gas and also, when it is opened, air from outside can enter the inside space, the maintenance of a slight excess pressure compared with the ambient air produces a flow of air from the inside outwards, with the result that clean, cooled and germ-free air has to be fed continuously into the inside space, whereby the air throughout the inside space of the display cabinet is completely renewed over a period of a few days, depending on its size. In this way a completely germ-free atmosphere is achieved after a certain time.

DE-PS 198 26 930 C2 describes a climate-controlled display cabinet, in which a flat heat exchanger is in the inside space of the cabinet and a collecting and humidifying tray is arranged under it, the heat exchanger being connected to a refrigerating machine. From the description it can be seen that by means of a fan, a controlled flow of air can be passed through a number of cabinets connected in series. In contrast, in the present invention the controlled airflow first passes into a container holding a liquid and then to a cooler.

The climate-control of a display cabinet is also the object of WO 01/84986 A1, in which the air inside a display cabinet is propelled through a dehumidifying and heating/cooling device. The said device contains a hygroscopic medium, for example silica gel, which has to be replaced as soon as it has absorbed too much water.

An air purification system in which genns are also removed from the air is described in DE-OS 199 03 022 A1, in which the air is treated by an electrostatic device. Such a device is intended for use in many ways, such as in the air ducts of climate-control units in which the heated or cooled air is subjected to germ removal. The description does not mention how such germ removal is to take place in the case of display cabinets. In contrast, in the present invention the air humidity of the already germ-free air is adjusted and/or controlled in combination with a cooling device.

In collaboration with the liquid containing an additive, the catalyser according to the invention frees the air that has been brought into contact with the liquid from germs.

Other advantages emerge from the subordinate claims relating to the method and device according to the invention.

The invention will be explained in more detail with reference to one example embodiment illustrated in the drawing, which shows:

FIG. 1: Section through a container of liquid with a sponge, which is surrounded by a catalyser The FIGURE shows an embodiment in which the dust-free airflow 5 is passed into a sponge 11, the sponge 11 being enveloped by the grid of the catalyser 8. The humidified air escapes from the sponge 11 and rises to the surface of the liquid 7.—The further treatment of the cleaned and humidified air 6 then takes place in the following manner:

The air so treated is passed into a cooling device 4 in which the humidity of this air is adjusted and regulated to a specified value. The air 6 treated in this way is then passed by means of a pump (not shown) into the inside space of the display cabinet. The pump serves to maintain a slight excess pressure in the inside space 1 of the cabinet, and only has to deliver an amount of air sufficient to make up for any air that escapes to the outside by leaking out of the cabinet. The cooling device 4 and the pump (not shown) are controlled by a control unit 3 to which sensors (not shown) for air pressure and humidity positioned in the inside space 1 of the display cabinet are connected, so that the pump is correspondingly controlled as a function of the specified air pressure, and the cooling device 4 as a function of the specified air humidity. A monitoring device (not shown) for the filling level of liquid 7 in the container 2 can also be connected to the control unit 3, and by means of an acoustic and/or visual signal this indicates when the liquid reserve in the container 2 should be topped up.—The sponge must be covered by the liquid 7 at least sufficiently for the catalyser 8 to be below the surface of the liquid 7.

The catalyser can take any form such as wire, sheet, chips or powder, which will ensure the presence of a sufficiently large active surface area. The alloy used for the catalyser consists of 10 to 80 mass-% of cobalt, 5 to 50 mass-% of nickel, 5 to 20 mass-% of tungsten and 5 to 25 mass-% of chromium, heat treated in an atmosphere containing oxygen for 0.05 to 3 hours at temperatures in the range 250° to 1,250° C. Such a catalyser remains highly active for prolonged periods. An example of such a catalyser is commercially available from MOL Katalysatortechnik GmbH, Leunastr. 6, D-06258 Schkopau, Germany marketed as the MQL ox catalyst.

The enforced leading of the air being within the cabinet through the catalyst situated within the liquid causes the acceptance of moisture of the liquid. By this procedure the air coming out of the catalyst is sterile because the liquid is sterilized by the catalyst.

European Patent EP 0 819 468B1 concerning the operation of the special catalyst informs generally of the purification of liquids for example of dirty water. Glasbau Hahn had been in close cooperation with the patent owner of the named patent concerning the use of the catalyst for the sterilization of the air within the cabinet. Before presenting such a cabinet on the market Glasbau Hahn had tested the function of the catalyst in order to prove that the expected result i.e. the sterilization of the air is achieved.

The described technology is suitable to eliminate bio-layers and free germs in water.

The metallic catalysts may be especially made of knitted wire with a special surface. The catalyst is formed to catalyst elements. The most important element consists of a frame on which the catalyst is fixed.

The collaboration of the catalyser 8 with water as the liquid 7 already frees the air in the inside space 1 of the display cabinet from genns. In particular cases when the objects on display in the cabinet so allow or require, the liquid 7 can for example also contain a certain amount of hydrogen peroxide.

A 30% solution of hydrogen peroxide may be used. This 30% solution of hydrogen peroxide is commercially available as MOLaktiv E 30 marketed by MOL Katalysatortechnik GmbH. Such a product is authorized by EU-biocide-guideline.

In water the solution is adsorbed and activated at the catalyst surface by an electron transfer from catalyst to hydrogen peroxide. As a result of this catalyst will be positively charged. Free genus are negatively charged. For this reason free germs are attracted to the catalyst by electrostatic interaction.

At the catalyst surface the attracting genus react with adsorbed hydrogen peroxide to biosurfactants and water. Furthermore adsorbed germs give back electrons to the catalyst. Biosurfactants are partially oxidized cell components. They are adsorbed by biolayer. As a result of this the biolayer is removed from surfaces of materials. The removed biolayer is biologically inert. Without biolayer there is no habitat for bacteria.

The humidified and germ-free air is passed into the inside space 1 of the display cabinet, whereby the air surrounding the displayed objects in the cabinet also becomes free from germs since after some time the air in the inside space 1 will have been completely renewed due to leaks, and the air can then be kept continually free from germs.

In the description of the embodiment shown in the FIGURE it has so far been assumed that the germ-free air is then passed into a cooling device 4 and thence to the inside space 1 of the display cabinet. It is also conceivable, however, to pass the air first into a cooling device 4 and only then to subject it to the treatment for germ removal. Depending on the ambient temperature of the display cabinet, the cooling device 4 can serve to adjust the air humidity and/or temperature of the air in the inside space 1 of the cabinet, by heating or cooling the air. In this it is also conceivable, if the cooling device 4 is of appropriate design, i.e. when in accordance with the state of the art, in combination with water a specified air humidity and/or air temperature can be established, to combine the cooling device 4 with the device according to the invention for eliminating germs from the air, since the water serves both to adjust the air humidity and/or temperature and also, by virtue of the additive in combination with the catalyser, to eliminate germs from the air.

The air 5 treated to remove dust can all come from the air outside the display cabinet, but it is also conceivable for some of this air to come from the inside space 1 of the cabinet, whereby the air replacement in the inside space 1 is accelerated.

The device described for humidifying and eliminating germs from the air in the inside space 1 of a display cabinet can be positioned individually as closed units inside the cabinet. It is also conceivable, however, if there are several display cabinets, to provide a common device to which only the inside space 1 with the air duct(s) and with the sensors is connected.

The invention can be used both for display cabinets in which objects are set out for display, and with cabinets serving only for the storage of objects.

The invention claimed is:

1. Method for the treatment of air in a cabinet for the storage and/or display of objects, whose walls, floor and roof structure more or less enclose the inside space of the cabinet and in which a forced inflow from a air delivery system connected to the inside space of the cabinet maintains a slight excess pressure compared with the air outside it, this airflow passing through suitable dust or gas filtration means before entering the cabinet and having its air humidity adjusted and/or controlled, wherein after filtration the inflowing air (5) upon entering a container (2) passes through a catalyser (8) present in a liquid (7), the air (5) picks up moisture from the liquid and is rendered completely free from germs.

2. Method according to claim 1, characterised in that the liquid (7) consists of water.

3. Method according to claim 2, characterised in that the liquid (7) contains an additive.

4. Method according to claim 3, characterised in that the catalyser (8) consists of a wire grid made from a particular alloy.

5. Method according to claim 4, characterised in that the wire grid is made as a mat and is held between two protective gratings of at least the same size.

6. Method according to claims 4, characterised in that the airflow (5) is passed into a sponge (11) wetted by the liquid (7), which is enveloped by the wire grid.

7. Method according to claim 6, characterised in that the airflow (5) passing into the container (2) consists of two parts, one part from the outside air and one part from the air inside the display cabinet.

8. Method according to claims 7, characterised in that the germ-free air passes into a cooling/heating device (4), which serves to maintain a specified temperature and/or air humidity.

9. Method according to claim 7, characterised in that the airflow (5) first passes into a cooling/heating device (4) which serves to maintain a specified temperature and/or air humidity, and is then freed from germs.

10. Method according to claim 9, characterised in that the cooling/heating device (4) regulates the specified temperature and/or air humidity by means of a liquid, this liquid being identical to the liquid (7).

11. Display cabinet for implementing the method according to claim 1, whose walls, floor and roof structure more or less enclose the inside space of the display cabinet and in which a forced inflow of air from an air delivery system connected to the inside space of the cabinet maintains a slight excess pressure compared with the air outside it, this airflow passing through suitable dust or gas filtration means before entering the cabinet and having its air humidity adjusted and/or controlled, wherein after filtration the airflow (5) upon entering a container (2) passes through a catalyser (8) present in a liquid (7), the air (5) picks up moisture from the liquid and is rendered completely free from germs, the air subsequently passes to a cooling device.

12. Display cabinet according to claim 11, characterised in that the liquid (7) consists of water and contains an additive.

13. Display cabinet according to claim 12, characterised in that the liquid (7) contains a certain amount of hydrogen peroxide.

14. Display cabinet according to claim 13, characterised in that the catalyser (8) consists of a wire grid made from a particular alloy.

15. Display cabinet according to claim 14, characterized in that the wire grid is made as a mat and is held between two protective gratings of at least the same size.

16. Display cabinet according to claim 14, characterised in that a sponge (11) is enveloped by the wire grid and the airflow (5) is passed through the sponge.

17. Display cabinet according to claim 16, characterised in that the airflow (5) passing into the container (2) consists of two parts, one part from the outside air and one part from the air inside the display cabinet.

* * * * *